US005571280A

United States Patent [19]

Lehrer

[11] Patent Number: 5,571,280

[45] Date of Patent: Nov. 5, 1996

[54] LAMPSHADE

[75] Inventor: William M. Lehrer, Wellesley, Mass.

[73] Assignee: Photofabrication Engineering Inc., Milford, Mass.

[21] Appl. No.: 449,995

[22] Filed: May 25, 1995

[51] Int. Cl.[6] ..... F21V 1/00

[52] U.S. Cl. ..... 362/352; 362/351; 493/950

[58] Field of Search ..... 362/360, 361, 362/359, 351, 352, 346, 163, 320, 162; 493/950

[56] References Cited

U.S. PATENT DOCUMENTS

| | | | |
|---|---|---|---|
| 75,418 | 3/1868 | Hartshorn | 362/360 |
| 86,987 | 2/1869 | Laws | 362/360 |
| 103,928 | 6/1870 | Read, Jr. | 362/360 |
| 4,428,030 | 1/1984 | Baliozian | 362/352 X |
| 4,616,293 | 10/1986 | Baliozian | 362/352 X |
| 5,051,879 | 9/1991 | Bunger | 362/351 |
| 5,264,996 | 11/1993 | Bek, Jr. et al. | 493/250 X |

FOREIGN PATENT DOCUMENTS

| | | | |
|---|---|---|---|
| 2727136 | 12/1978 | Germany | 362/360 |

*Primary Examiner*—Ira S. Lazarus
*Assistant Examiner*—Thomas M. Sember
*Attorney, Agent, or Firm*—Kriegsman & Kriegsman

[57] ABSTRACT

A lampshade made of a sheet of aluminum which is shaped by photochemical etching to form a one piece blank having six trapezoidally shaped side wall panels connected to one another in sequence in side-by-side relationship by fold lines, a plurality of locking tabs extending out from the side wall panel at one end of the sequence, an auxiliary panel extending out from the side wall panel at the other end of the sequence, and a plurality of locking slots formed on the auxiliary panel for engagement by the locking tabs to hold together the side wall panels at the ends of the sequence so as to form the lampshade. The blank is further shaped to include a first reinforcing flap hingedly connected to the top edge of each side wall panel by a fold line, a second reinforcing flap hingedly connected to the bottom edge of each flap by a fold line and a third reinforcing flap hingedly connected to at least some of the first reinforcing flaps, also each by a fold line, and a holding tab extending out from at least some of the side panels and being bendable into a holder for a leg of a spider which may be used to mount the lampshade on a lamp.

14 Claims, 6 Drawing Sheets

LAMPSHADE

BACKGROUND OF THE INVENTION

The present invention relates generally to lampshades and, more particularly, to a new and novel method of fabricating a lampshade and to the lampshade which is fabricated according to the method. Although the lampshade of this invention is especially useful with lamps in which the light source is a candle, it is to be understood that the lampshade is not intended to be limited to use exclusively with candle type lamps, but can, if desired, be used with other types of lamps such as, for example, electric bulb type lamps.

In the past, lampshades have been made of materials such as paper, parchment, cotton, silk and other fabric materials. Although these lampshades have proven to be generally satisfactory when used with lamps in which the light source is an electric light bulb, such lampshades have not proven to be very satisfactory when used with lamps in which the light source is a candle. The main reason for this is that these materials are flammable.

Lampshades have also been made out of stamped sheets of galvanized iron or brass, with the ends of the sheets being joined together by soldering to form the lampshade. Such lampshades have found use in connection with candle type lamps. Although not flammable, such lampshades have not proven to be entirely satisfactory since galvanized iron or brass becomes rather hot after it has been exposed to heat emitted from a candle after a short period of time, does not give up heat quickly and is not easily cleanable.

Lampshades have also been made which are in the form of a molded piece of plastic. However, for a number of reasons, these lampshades have not been used with candle type lamps.

Accordingly, it is an object of this invention to provide a new and novel method of making a lampshade.

It is another object of this invention to provide a method of making a lampshade which does not involve soldering pieces together.

It is still another object of this invention to provide a method of making a lampshade which is economical and fast.

It is yet still another object of this invention to provide a method of making of making a lampshade which includes an ornamental design and wherein the shape of the ornamental design can be easily changed from one lamp to the next to meet customer needs.

It is an additional object of this invention to provide a method of making a one piece blank which can be erected into a lampshade.

It is a further object of this invention to provide a new and novel lampshade.

It is still a further object of this invention to provide a lampshade which is made of a single sheet of metal.

It is yet still a further object of this invention to provide a lampshade which is especially useful with candle type lamps.

It is another object of this invention to provide a lampshade which is made of metal, does not contain any sharp edges and is a good heat reflector.

It is a further object of this invention to provide a one piece metal blank which can be erected into a lampshade.

SUMMARY OF THE INVENTION

A lampshade constructed according to this invention comprises a one piece metal blank having a front surface and a rear surface and including at least three side wall panels connected to one another in sequence in side-by-side relationship by fold lines, the side wall panel at each end of the sequence having an outer side edge, a locking tab extending out from the outer side edge of the side wall panel at one end of the sequence, an auxiliary panel extending out from the outer side edge of the side wall panel at the other end of the sequence, said auxiliary panel having an inner edge, and a locking slot formed on the auxiliary panel adjacent its inner edge for engagement by the locking tab to hold together the side wall panels at the ends of the sequence so as to form the lampshade.

A method of making a lampshade according to this invention comprises providing a sheet of metal, said sheet of metal having a front surface and a back surface, forming from said sheet of metal by photochemical etching a one piece blank having at least three side wall panels connected to one another in sequence in side-by-side relationship by fold lines, the side wall panel at each end of the sequence having an outer side edge, a locking tab extending out from the outer side edge of the side wall panel at one end of the sequence, an auxiliary panel extending out from the outer side edge of the side wall panel at the other end of the sequence, said auxiliary panel having an inner edge and a locking slot adjacent to said inner edge for engagement by said locking tab to hold together the side wall panels at the ends of the sequence so as to form the lampshade, and then erecting said one piece blank to form said lampshade.

Various,features and advantages will appear from the description to follow. In the description, reference is made to the accompanying drawing which forms a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF PREFERRED EMBODIMENTS

The present invention is directed to a method of making a lampshade. The method involves making a one piece metal blank by photochemical etching and then erecting the one piece metal blank to form the lampshade. The invention is also directed to the lampshade so produced.

Figure 1:
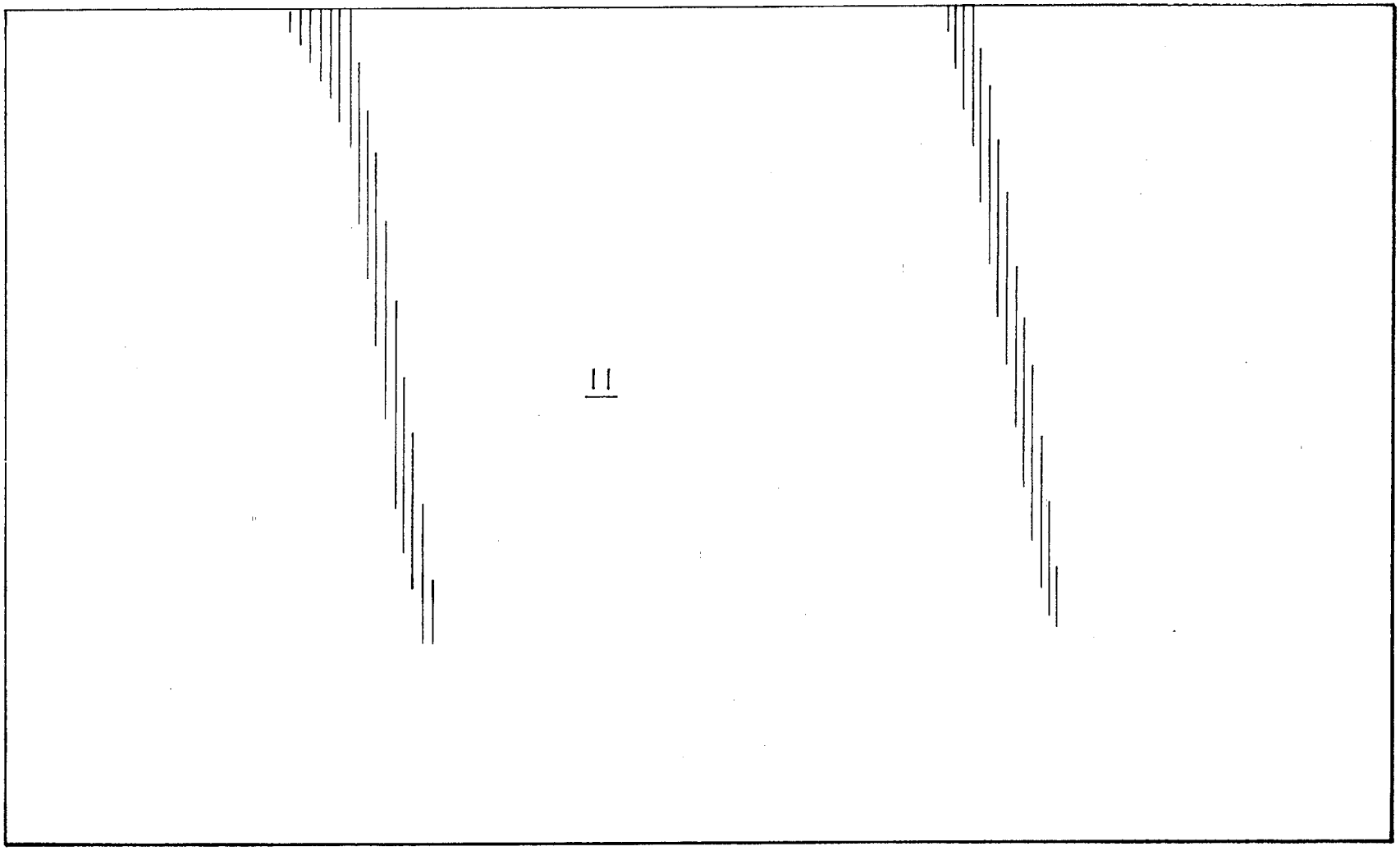
FIG. 1 is a plan view of a sheet of aluminum from which a lampshade can be made according to this invention.

Referring now to the drawings, there is shown in FIG. 1 a plan view of a sheet of metal 11 from which a lampshade can be constructed according to this invention. Sheet 11 is preferably about 0.016" thick all made of aluminum. Aluminum is desirable for use because of its heat emissivity and conductivity; however, any other metal which may be photochemically etched can be used.

Figures 2, 2A:
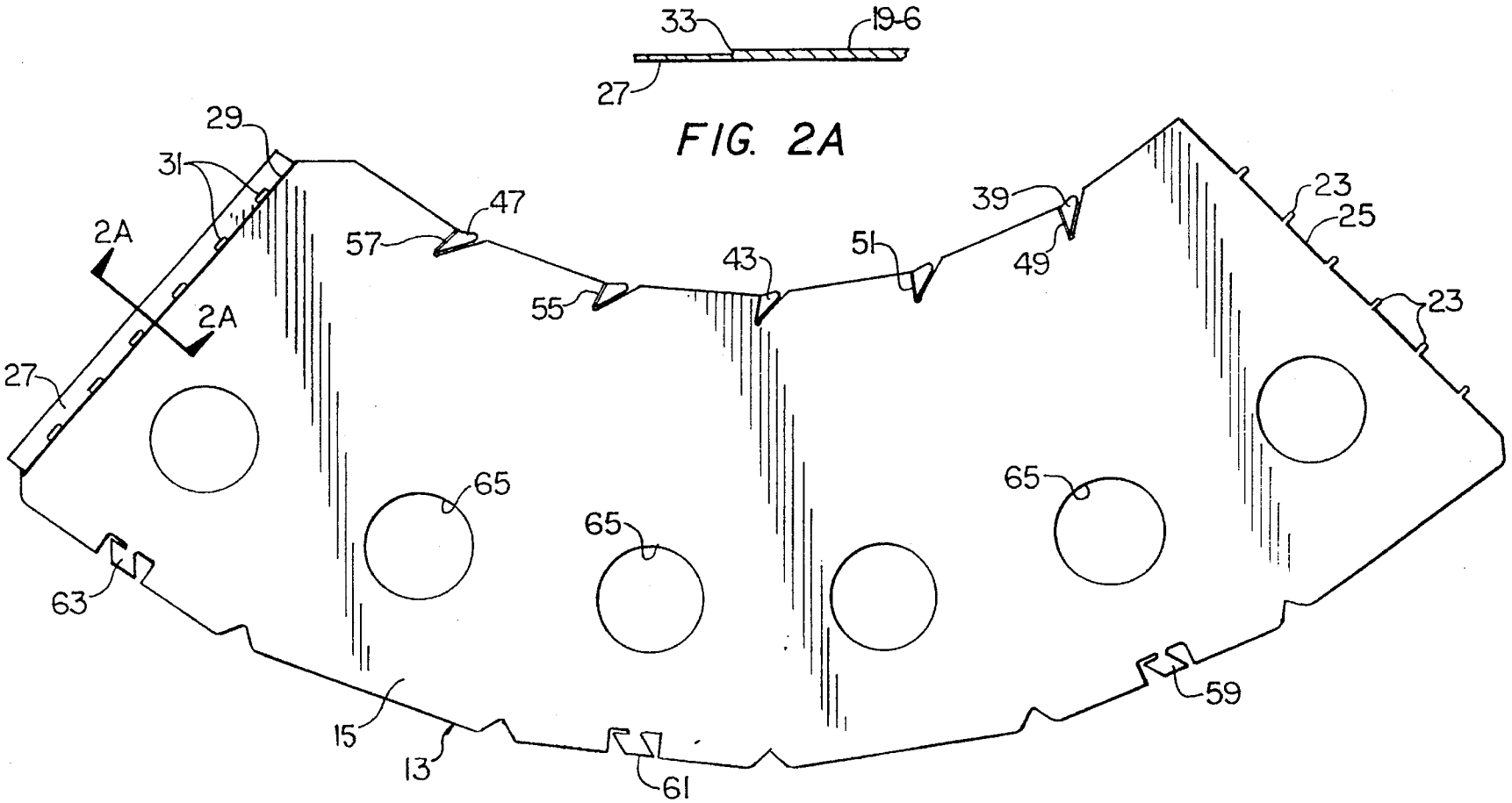
FIG. 2 is a plan view taken from the front of a one piece blank made according to this invention from the sheet of aluminum shown in FIG. 1 and from which can be erected a lampshade according to this invention.
FIG. 2A is an enlarged section view taken along line 2A—2A in FIG. 2.
Figures 3, 4B:
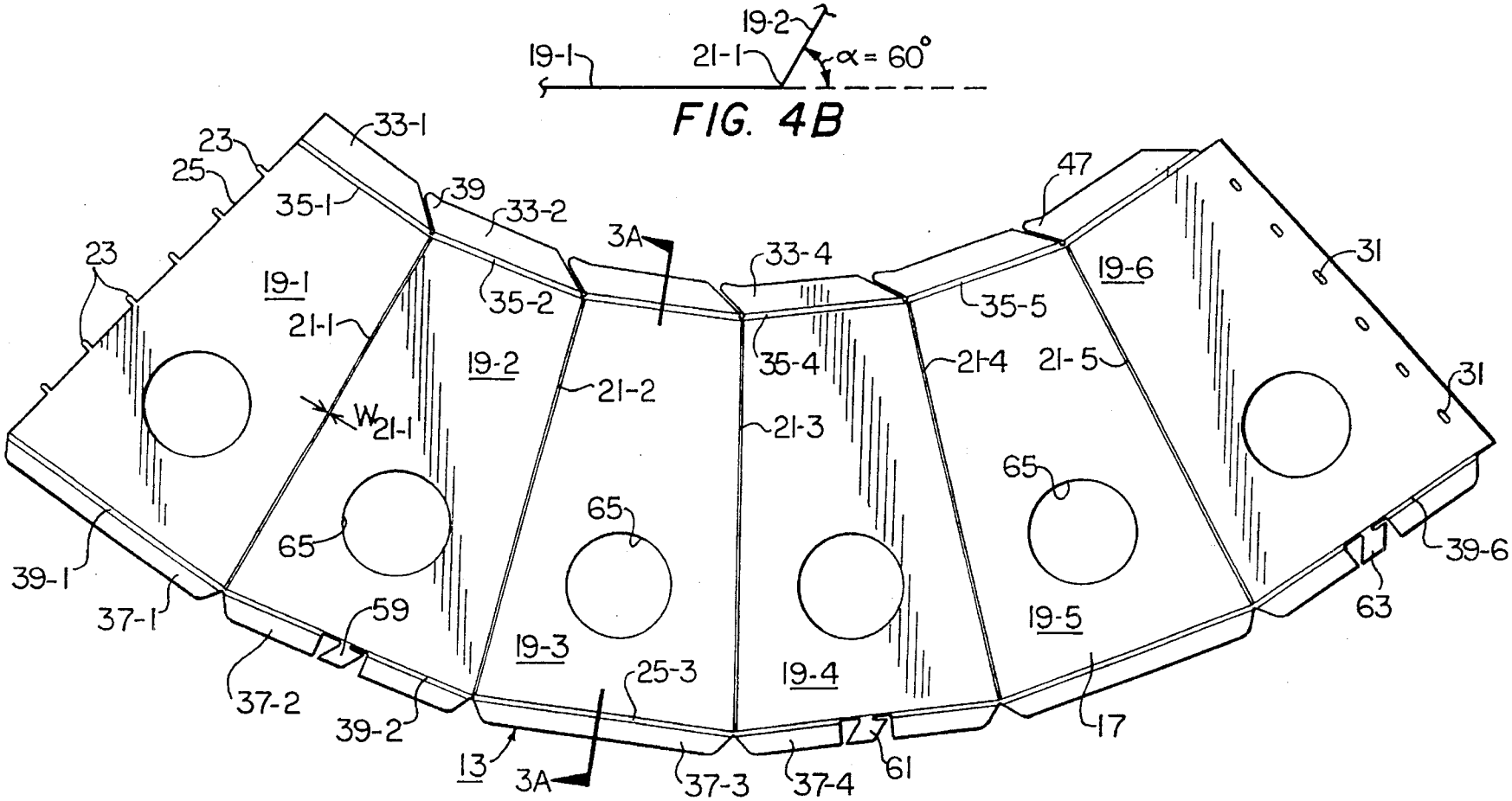
FIG. 3 is a plan view taken from the rear of the one piece blank shown in FIG. 2.
FIG. 4B is a diagram useful in understanding the invention.
Figure 7:
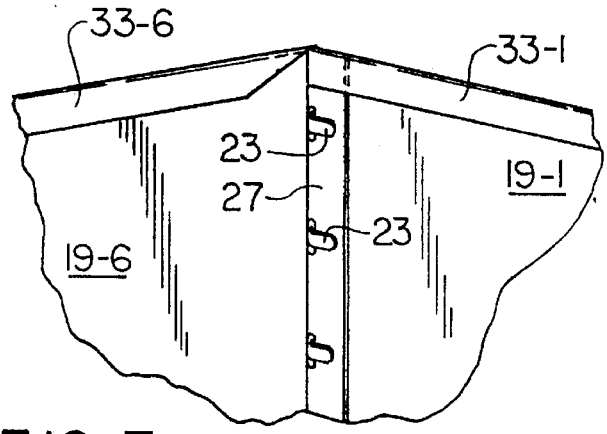
FIG. 7 is an enlarged fragmentary perspective view of the lampshade shown in FIG. 5.
Figure 6:
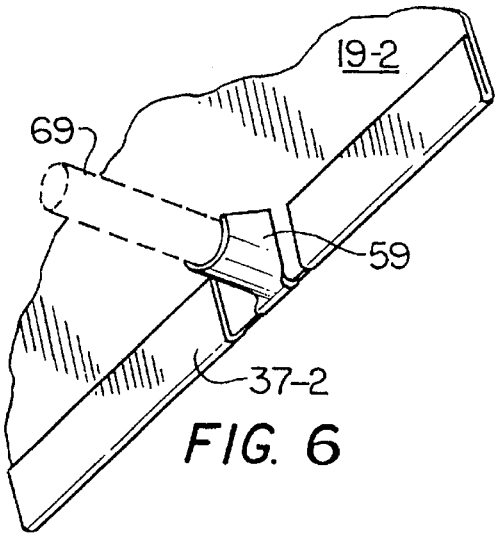
FIG. 6 is an enlarged fragmentary perspective view of one of the side panels in the lampshade shown in FIG. 5.
Figure 3A:
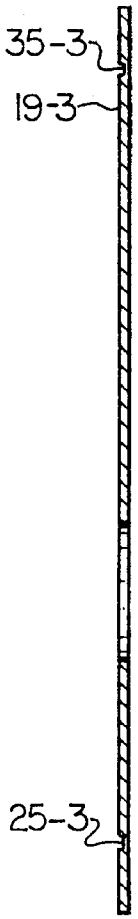
FIG. 3A is an enlarged section view taken along line 3A—3A in FIG. 3.
Figure 3B:
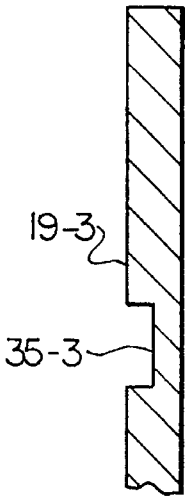
FIG. 3B is an enlarged fragmentary view of the section view in FIG. 3A.

Referring now to FIGS. 2 through 7, there is shown in FIG. 2 a plan view taken from the front of a one piece blank made from sheet 11, the one piece blank being identified by reference numeral 13 and the front surface of one piece blank being represented by reference numeral 15. A plan view of blank 13 taken from the rear is shown in FIG. 3, the rear surface being identified by reference numeral 17.

Blank 13, as can be seen in FIG. 3, includes six trapezoidally shaped side wall panels 19-1 through 19-6 connected to one another in sequence in side-by-side relationship by fold lines 21-1 through 21-5. In FIG. 3, panel 19-1 is shown at the left end of the sequence and panel 19-6 is shown at the right end of the sequence.

A plurality of locking tabs 23 extend out from the outer side edge 25 of side wall panel 19-1, and a rectangularly shaped auxiliary panel 27, see FIG. 2, extends out from the outer side edge of side wall panel 19-6. The thickness of auxiliary panel 27, see FIG. 2A, is less than the thickness of side wall panel 19-6, with the outer edge of side wall panel 19-6 and the inner edge of auxiliary panel 27 being one and the same and identified by reference numeral 29. A plurality of locking slots 31 are formed on auxiliary side panel 31 adjacent edge 29 for engagement by locking tabs 27.

A set of first reinforcing flaps 33-1 through 33-6 are hingedly connected to side wall panels 19-1 through 19-6, respectively, by fold lines 35-1 through 35-6, respectively, these fold lines constituting the top edge of side wall panels 19-1 through 19-6, respectively, and the bottom edges of first reinforcing flaps 33-1 through 33-6, respectively. A set second reinforcing flaps 37-1 through 37-6 are hingedly connected to side wall panels 19-1 through 19-6, respectively, by fold lines 39-1 though 39-6, respectively, these fold lines constituting the bottom edges of side wall panels 19-1 through 19-6, respectively, and the top edges of second reinforcing flaps 37-1 through 37-6. Flaps 37-1, 37-3 and 37-5 are each a single section while flaps 37-2, 37-4 and 37-6 are each made up of two spaced apart sections. A set of three sided third reinforcing flaps 39, 41, 43 and 45 and 47 are hingedly connected to first reinforcing flaps 33-2 through 33-6, respectively, by fold lines 49, 51, 53, 55 and 57, respectively, see FIG. 2, these fold lines constituting a side edge of first reinforcing panels 33-2 through 33-6, respectively and a side edge of flaps 39, 41, 43, 45 and 47, respectively.

A set of three tabs 59, 61, and 63 extend down from panels 19-2, 19-4 and 19-6, respectively, between the two spaced apart sections of second reinforcing flaps 37-2, 37-4 and 37-6, respectively. Holding tabs 59, 61 and 63 are used to form holders for holding a spider used in mounting the lampshade on a lamps will hereinafter be explained.

An ornamental design 65 is formed on each side wall panel 19. For illustrative purposes, the design on each panel 19 is the same and for simplicity is shown as a circle.

The process of making blank 13 form sheet 11 by photochemical etching includes cleaning both sides of the sheet, coating each side of the sheet with a layer of photoresist, making a first template of photographic film corresponding to the pattern desired on one side of sheet 11 and a second template of photographic film corresponding to the pattern desired on the other side of sheet 11, exposing one side of the coated sheet to high intensity ultraviolet light through the first template and the other side of the coated sheet to high intensity ultraviolet light through the second template, preferably simultaneously, the two templates being aligned with one other but on opposite sides of the sheet, removing the unexposed photoresist on both sides of the sheet, chemically etching away the metal that is not covered with the photoresist and then stripping away the photoresist remaining on the sheet.

The photoresist employed may either be a positive photoresist or a negative photoresist. If a negative photoresist is used, the templates are constructed so that the layer of photoresist covering areas on the sheet that are not to be chemically etched away. If a positive photoresist is used the templates are constructed to produce the opposite effect.

As can be appreciated, the ornamental design can be changed easily by changing the design on the templates.

As can also be appreciated, the number of side panels shown for lampshade 67 is for illustrative purposes only, it being understood that any number of panels greater than two may be employed.

The width of each fold line in blank 13 is preferably sized to limit the fold at that fold line to a maximum number of degrees.

The width of fold lines 21, 25 and 35 in blank 13 is preferably determined according to the equation:

$$W = \frac{2\pi T}{n}$$

where:

W=the width of the fold line,

T=the thickness of sheet 11, and $$n = \frac{360^\circ}{\text{the bend angle } (\alpha) \text{ in degrees between a part on one side of the fold line and the flat}}$$

Since blank 13 is erectable into a six sided lampshade, the bend angle, $\alpha$ for example, between side panel 19-2 and the flat is 60°, as seen in FIG. 4B and n is therefore, $$\frac{360^\circ}{60^\circ} \text{ or } 6.$$

Thus, the width of fold line 21-1 is:

$$W_{21-1} = \frac{(2)(\pi)(0.0016)}{6} = .0017''$$

Similarly, for fold line 25-3, for example, the width is 0.05".

Figure 5:
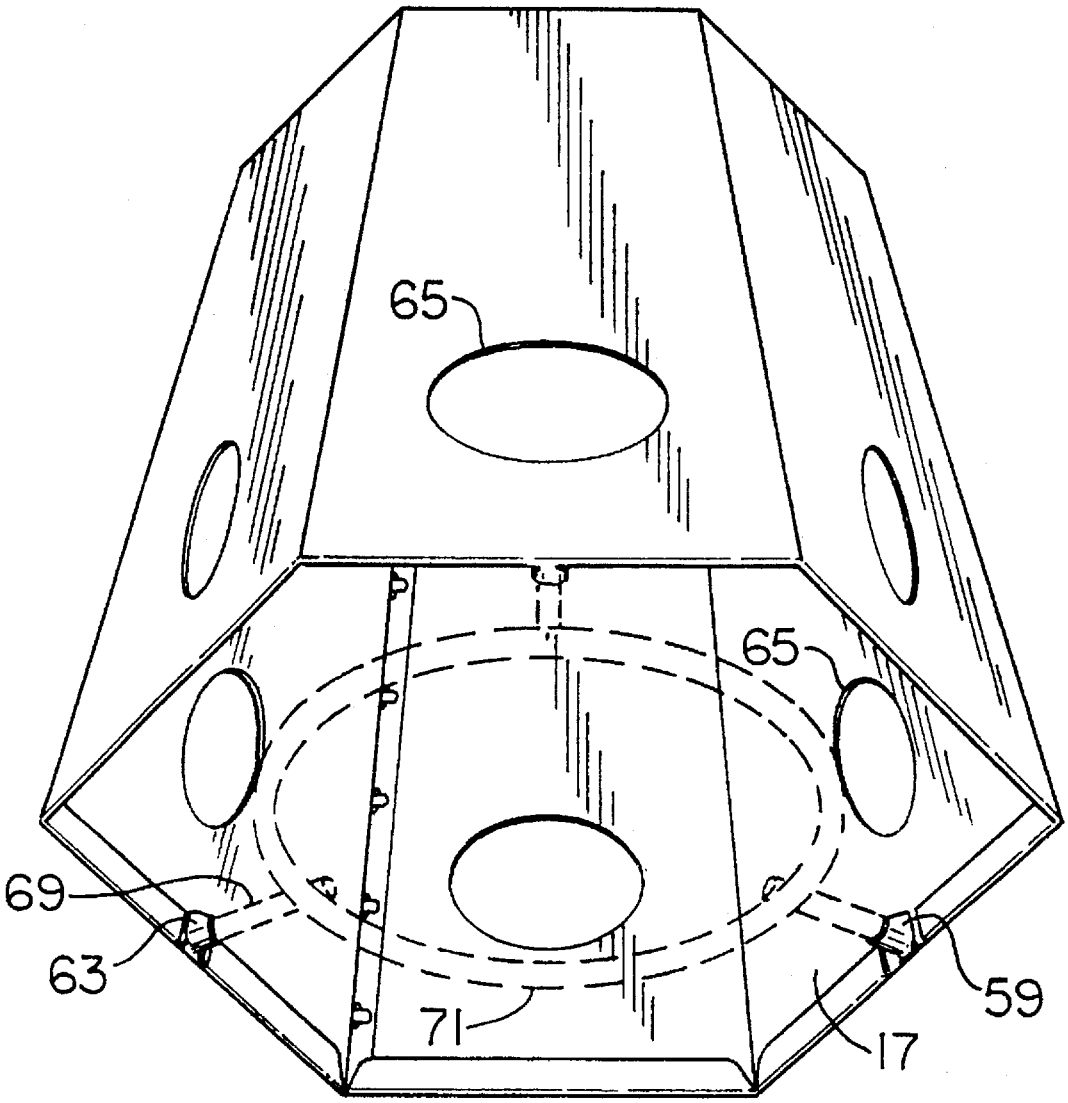
FIG. 5 is a perspective view taken from the bottom of a fully erected lampshade made from the one piece blank shown in FIG. 2.

For fold lines 49, 51, 55 and 57, the width is calculated using the same equation, except that the bend angle is made a few degrees less than 60°, such as 55°. In this way, the third reinforcing flaps act like springs pushing against the side panels to fold them in place. Referring now to FIG. 5, there is shown a perspective view of a lampshade erected from blank 13, the lampshade being identified by reference numeral 67.

Lampshade 67 may be erected from blank 13 in the following manner.

First, tabs 59, 61 and 63 are bent using pliers or any similar hand tool to form holders for holding the legs 69 of a spider 71 and side panels 19 are folded to form a six sided structure with tabs 23 inserted into slots 31 and bent over to hold the two ends of blank 13 in place. Then first, second and third flaps are folded over to hold the assembled structure in place.

Figure 4:
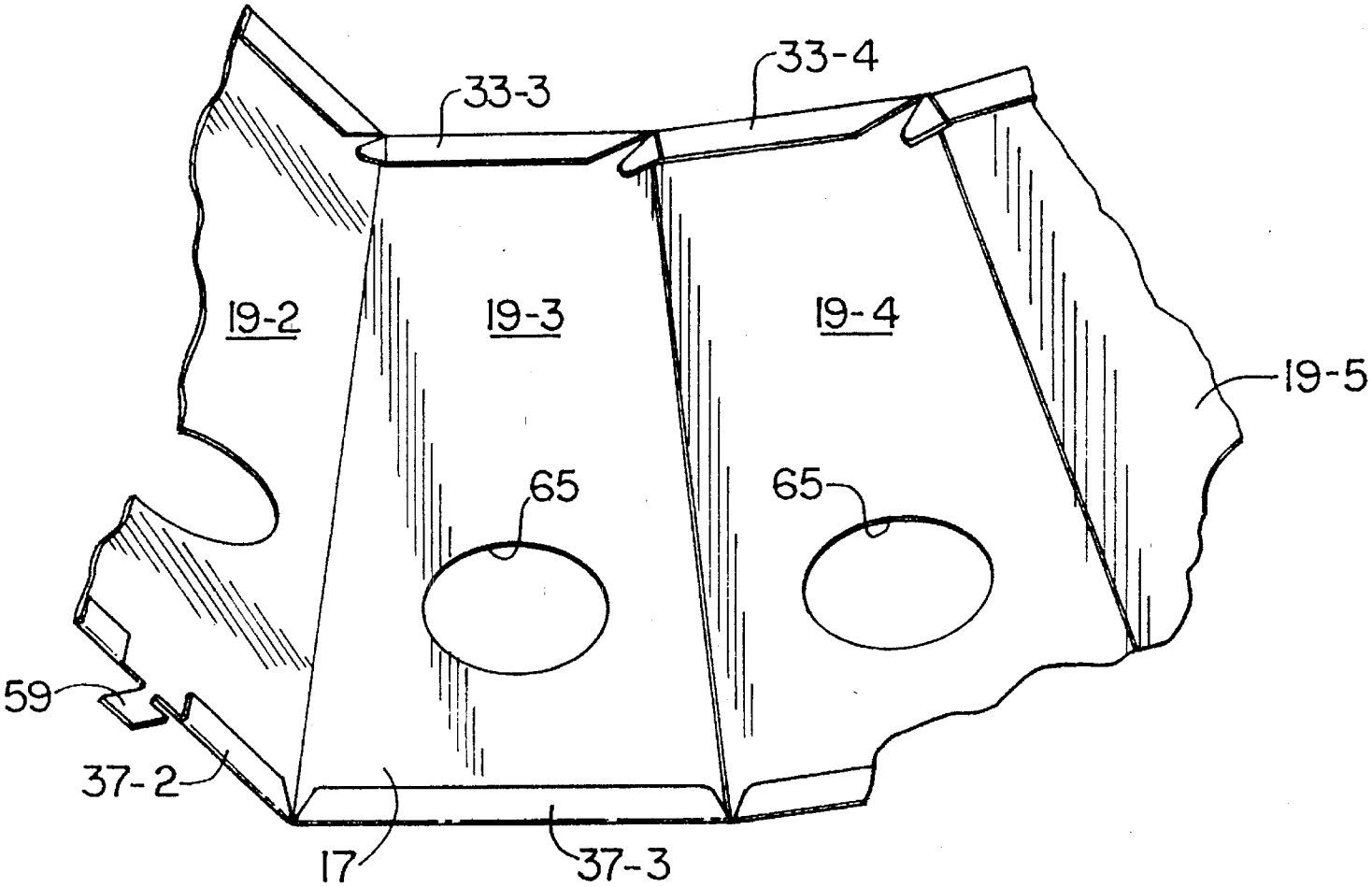
FIG. 4 is a fragmentary perspective view of the one piece blank shown in FIG. 3 in a partly folded position.

It should be noted that in FIG. 4, panel 19-2 has been folded up towards panel 19-3, but panel 19-3 has not been folded relative to panel 19-4 and panel 19-4 has not been folded relative to panel 19-5. It should also be noted that fold lines 49, 51, 53, 55 and 57 are angled so as to be aligned with fold lines 21-1 through 21-5 respectively, after the panels and flaps are folded in place but not before. This is shown clearly in FIG. 4.

It should also be noted that etched lines allow folding the various parts on the fold lines without tooling. That is, all folds can be done manually.

The embodiment of the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A lampshade comprising a one piece metal blank having a front surface and a rear surface and including:

a. at least three side wall panels connected to one another in sequence in side-by-side relationship by fold lines, each side wall panel at each end of the sequence having an outer side edge, b. a locking tab extending out from the outer side edge of the side wall panel at one end of the sequence, c. an auxiliary panel extending out from the outer side edge of the side wall panel at the other end of the sequence, said auxiliary panel having an inner edge, and d. a locking slot formed on the auxiliary panel adjacent its inner side edge for engagement by said locking tab to hold together the side wall panels at the ends of the sequence so as to form the lampshade.

2. The lampshade of claim 1, wherein each side wall panel includes a top edge and a bottom edge and said one piece metal blank further includes a first reinforcing flap hingedly connected to the top edge of each side wall panel by a fold line.

3. The lampshade of claim 2, wherein said one piece metal blank further includes a second reinforcing flap hingedly connected to the bottom edge of each flap by a fold line.

4. The lampshade of claim 3, wherein said one piece metal blank further includes a third reinforcing flap hingedly connected to at least some of said first reinforcing flaps by a fold line.

5. The lampshade of claim 4, wherein said one piece metal blank includes a holding tab extending out from at least some of the side wall panels and bendable into a holder for use in holding a leg of a spider used in mounting the lampshade on a lamp.

6. The lampshade of claim 5, wherein each side wall panel has four sides.

7. The lampshade of claim 6, wherein said sheet of metal is aluminum.

8. The lampshade of claim 7, wherein the side wall panels are trapezoidally shaped.

9. the lampshade of claim 8, wherein the fold lines hingedly connecting the side wall panels are formed on said back surface of the single sheet of metal.

10. The lampshade of claim 9, wherein the fold lines hingedly connecting the first reinforcing flaps to the side wall panels and the second reinforcing flaps to the side wall panels are formed on the back surface of the one piece metal blank.

11. The lampshade of claim 10, wherein the side panels have the same thickness and auxiliary panel has a thickness less than that of the side panels.

12. The lampshade of claim 11 wherein the width of each fold line is determined by the equation:

$$W = \frac{2\pi t}{n}$$

where:

W=the width of the fold line, t=the thickness of the sheet of metal, and $$n = \frac{360}{\text{the desired bend angle in degrees}}$$

13. A method of making a lampshade comprising:

a. providing a single sheet of metal, said single sheet of metal having a front surface and a back surface, b. forming from said single sheet of metal by photochemical etching a one piece blank having at least three side wall panels connected to one another in sequence in side-by-side relationship by fold lines, a locking tab extending out from the side wall panel at one end of the sequence, an auxiliary panel extending out from the side wall panel at the other end of the sequence and having an inner edge and a locking slot formed on the auxiliary panel adjacent its inner edge for engagement by said locking tab to hold together the side wall panels at the ends of the sequence so as to form the lampshade, and c. erecting said one piece blank to form said lampshade.

14. A lampshade made according to the method of claim 13.

* * * * *